US005330125A

United States Patent [19]

Dylla

[11] Patent Number: 5,330,125

[45] Date of Patent: Jul. 19, 1994

[54] METHOD AND APPARATUS FOR FORMATION AND HOLDING OF A LOOSE STARTING FLAP OF A REPLACEMENT PAPER ROLL, TYPICALLY A PAPER ROLL IN A PRINTING MACHINE ROLL CHANGER

[75] Inventor: Norbert Dylla, Stadtbergen, Fed. Rep. of Germany

[73] Assignee: MAN Roland Druckmaschinen AG, Offenbach am Main, Fed. Rep. of Germany

[21] Appl. No.: 971,042

[22] Filed: Nov. 3, 1992

[30] Foreign Application Priority Data

Nov. 30, 1991 [DE] Fed. Rep. of Germany ..... 4139586

[51] Int. Cl.[5] ..... B65H 19/10

[52] U.S. Cl. ..... 242/562

[58] Field of Search ..... 242/58.5, 78.8, 55, 242/58

[56] References Cited

U.S. PATENT DOCUMENTS

| | | | |
|---|---|---|---|
| 4,555,288 | 11/1985 | Nozaka | 242/58.5 X |
| 4,802,632 | 2/1989 | Fukuda et al. | 242/58.5 |
| 4,821,971 | 4/1989 | Watanabe et al. | 242/55 |
| 5,092,533 | 3/1992 | Gangemi | 242/56 R X |
| 5,094,394 | 3/1992 | Saukkonen | 242/55 |

FOREIGN PATENT DOCUMENTS

| | | |
|---|---|---|
| 0129238 | 12/1984 | European Pat. Off. . |
| 2534622 | 2/1977 | Fed. Rep. of Germany . |
| 2938685 | 6/1980 | Fed. Rep. of Germany . |
| 3441205 | 6/1985 | Fed. Rep. of Germany . |
| 3523139 | 2/1987 | Fed. Rep. of Germany . |
| 3811138 | 6/1989 | Fed. Rep. of Germany . |
| 3918552 | 12/1990 | Fed. Rep. of Germany . |

*Primary Examiner*—Daniel P. Stodola
*Assistant Examiner*—John Q. Nguyen
*Attorney, Agent, or Firm*—Frishauf, Holtz, Goodman & Woodward

[57] ABSTRACT

To form and hold a loose starting flap (5) of a replacement paper roll (1) in which the replacement paper roll has a starting portion which is adhered to an underlying layer of the roll, with a simple easily made and reliable apparatus, the uppermost layer of the roll is perforated by a perforating wheel (8) or an intermittently operated laser (1008) inwardly of the end edge of the starting portion along a perforation line (3) which extends essentially parallel to the axis of the roll to form a flap portion. A temporary or permanently adhering element, such as a suction roll (912), a suction bar, an adhesively coated strip or bar (812) or a roller (912) with an adhesive surface (9, 909, 912) is moved with respect to the flap portion close to the perforation line (3). The adhering element is then moved relative to the roll, either away from the circumference, radially or otherwise, or the roll is rotated, for example in clockwise direction, so that the uppermost layer will tear at the perforation line and form a flap (5), which will be retained, by adhesion, against the adhering element.

16 Claims, 3 Drawing Sheets

METHOD AND APPARATUS FOR FORMATION AND HOLDING OF A LOOSE STARTING FLAP OF A REPLACEMENT PAPER ROLL, TYPICALLY A PAPER ROLL IN A PRINTING MACHINE ROLL CHANGER

Reference to related U.S. Patent, the disclosure of which is incorporated by reference: U.S. Pat. No. 4,802,632, Fukuda to which German 38 11 138 corresponds.

Reference to publications in the Art of the subject matter of the present invention: German Patent 39 18 552.

FIELD OF THE INVENTION

The present invention relates to changing a roll of paper, which is about to expire, or run out to a new, or replacement roll, and more particularly to a method and apparatus to form, and then hold a loosened starting flap of the paper of the replacement roll. The invention is particularly applicable to paper rolls used in the printing field, in which large, heavy paper rolls are positioned on arms of a roll changer, of the type which is frequently used in conjunction with rotary printing machines.

BACKGROUND

U.S. Pat. No. 4,802,632, Fukuda, describes a method and an apparatus to handle the end portion of rolled paper on a paper roll by mechanical apparatus. The replacement roll has an end portion or initial portion adhered to the first underlying layer. This roll is mounted in the roll holder of the machine which is to handle the paper. With the roll braked, a cutter apparatus is engaged against the circumference of the replacement roll and moved transversely, in order to cut off a plurality of paper layers. These paper layers become scrap. This scrap is moved away by suction through an air suction tube to a suction transport apparatus. The suction transport apparatus then transfers the scrap paper layers to rollers which, in turn, transfer the scrap to a scrap receiving device.

This construction is expensive because it uses expensive mechanisms, and additionally, generates considerable scrap. The method has been found to be unreliable since the plurality of layers of the web must be transported by suction, and are subject to jamming in the suction conveyer. The high scrap which is generated also causes disposal problems.

German Patent 39 18 552 describes and arrangement in which only one layer of the replacement roll is cut. This requires a particular configuration of the end of the paper layers on the roll and specific positioning of the roll, as well as expensive mechanisms for cutting, positioning the roll, and sensing the initial portion. Thus, the overall mechanism is expensive.

THE INVENTION

It is an object to provide a method and an apparatus which, reliably, and with simple and inexpensive apparatus generates a loose starting flap, and holds the starting flap in position for, for example, adhesion to a running-out or expiring roll.

Briefly, the roll, when received, has its end adhered to the underlying layer. In accordance with the feature of the invention, the uppermost layer of the roll is perforated inwardly of the end edge of the starting portion, to, later on, define a flap portion. This perforation extends in a line essentially parallel to the axis of the roll. The flap portion, adjacent to the perforation, is then adhered, at least in part to an engaging device, e.g., a suction device, which, then, is moved relatively to the flap portion, e.g., away from the roll, so that the perforation will tear, and the end, which then forms the flap, will adhere to the adhering device.

The adhering device or apparatus can be a suction bar, a suction cylinder, a roll or strip which has a rough, and somewhat adhesive surface or any other simple and suitable arrangement to temporarily or permanently adhere the portion of the roll close to the perforation so that, when the apparatus and the roll are relatively moved, the perforation will tear and the flap will adhere to the adhering apparatus. This movement can be a relative radial movement, for example, by retaining the adhering apparatus in the frame which moves relative to the roll, or a relative rotary movement between the roll and the apparatus.

By only perforating the replacement roll, it is not necessary to arrange for holding or gripping of scrap material and to then transport the scrap material. It is only necessary to hold the initial portion of the web. This substantially increases the reliability of the method and as well of the apparatus.

A straight perforating cut, or perforation line can be easily made, to result in straight initial portion of the web. The flap portion can be easily handled. There is little scrap material and the apparatus can be made inexpensively.

DRAWINGS

DETAILED DESCRIPTION

Figure 1:
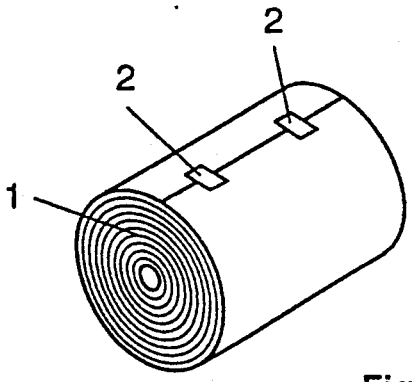
FIG. 1 is a perspective view of a paper roll, from which a flap is to be severed.

FIG. 1 illustrates a paper roll of the type customarily delivered to a printing installation, using rotary printing machines, for example, rotary offset printing machines. The roll 1, which is typically a replacement roll for an expiring or running-out web or roll, has the end of its end or top layer adhered to the next adjacent and underlying layer by adhesives strips 2.

Figure 2:
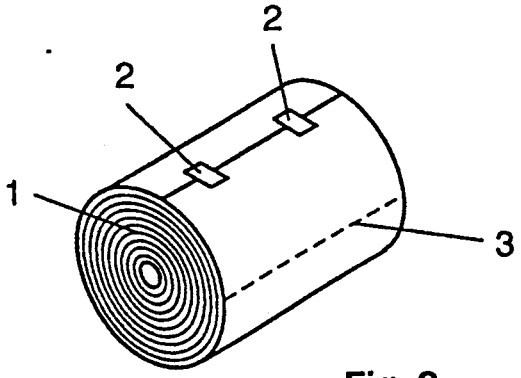
FIGS. 2 to 4 show the paper roll of FIG. 1 in various stages of generating the loose flap.

In a first operating step, see FIG. 2, a perforating line or perforating cut 3 is made. This perforation line 3 defines a flap portion on the uppermost layer between the end thereof and the perforation line 3. This cut extends essentially axially with respect to the roll 1 and is placed inwardly of or remote from the end of the top layer. In the next operating step, see FIG. 3, an adhering or holding strip 4 is applied against the roll 2, preferably immediately adjacent to and upwardly of perforating line 3. In the next step, see FIG. 4, the holding strip 4 is moved away from the circumference of the roll 1, and the perforation will tear. A flap 5 is thus formed.

Figure 5:
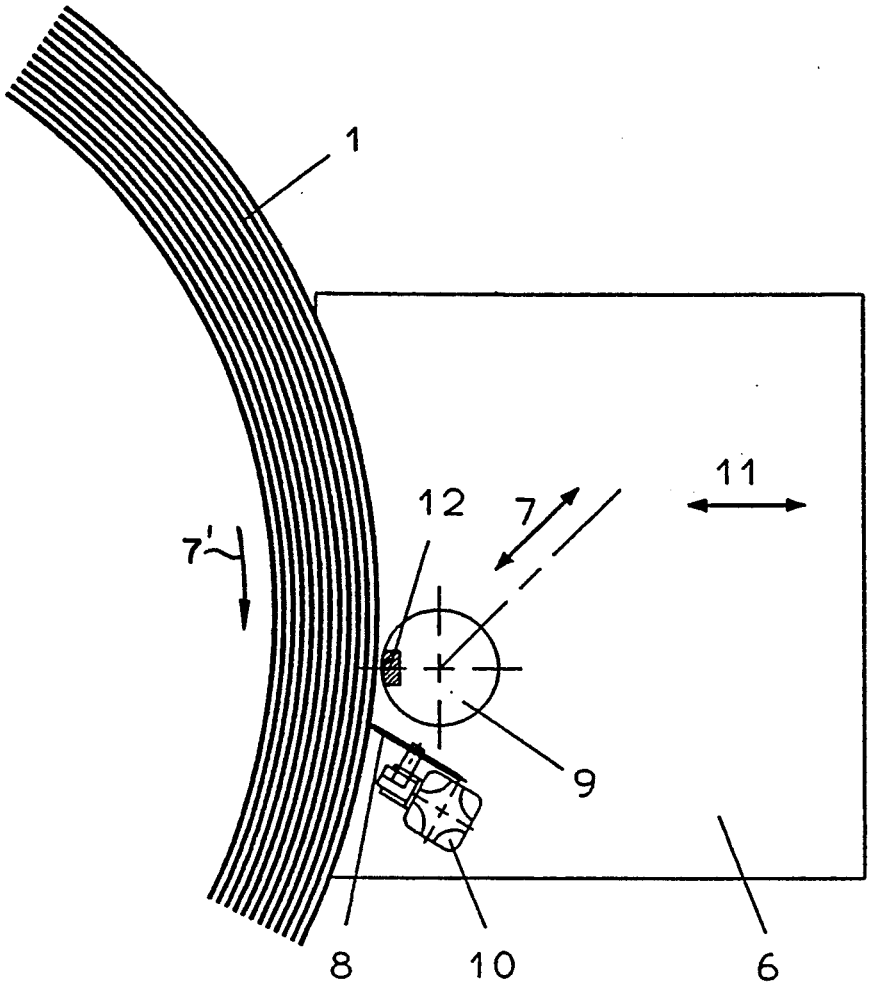
FIG. 5 is a highly schematic sideview of a portion of the paper roll, and one embodiment of an apparatus to perforate, and then sever the uppermost layer to form a flap.

FIG. 5 illustrates the apparatus to form the flap 5 in detail. The roll 1 is secured in the arms of a roll changer—not shown and of any suitable and well known or standard construction. Frame 6, which is shown only schematically, is of any suitable and well known construction. Frame 6, which can move in the direction indicated by the double arrow 11 is engaged against the circumference of the roll 1. The adhering or holding apparatus incudes a roller 9, which is coupled to a motion controlled apparatus of suitable construction, for example, in pneumatic or hydraulic piston-cylinder arrangement capable of moving the roller 9 in the direction of double arrow 7. A suction device 12, for example, a suction bar with a slit or a suction tube with appertured circumference is integrated in the roller 9. The suction device extends in axial direction with respect to the roller 9. In addition to the roller 9, the frame 6 retains a perforating blade, for example, a circular perforating blade 8, which is coupled to a longitudinal linear motion drive 10 to move the perforating blade 8 axially with respect to the paper roll 1.

Figure 6:
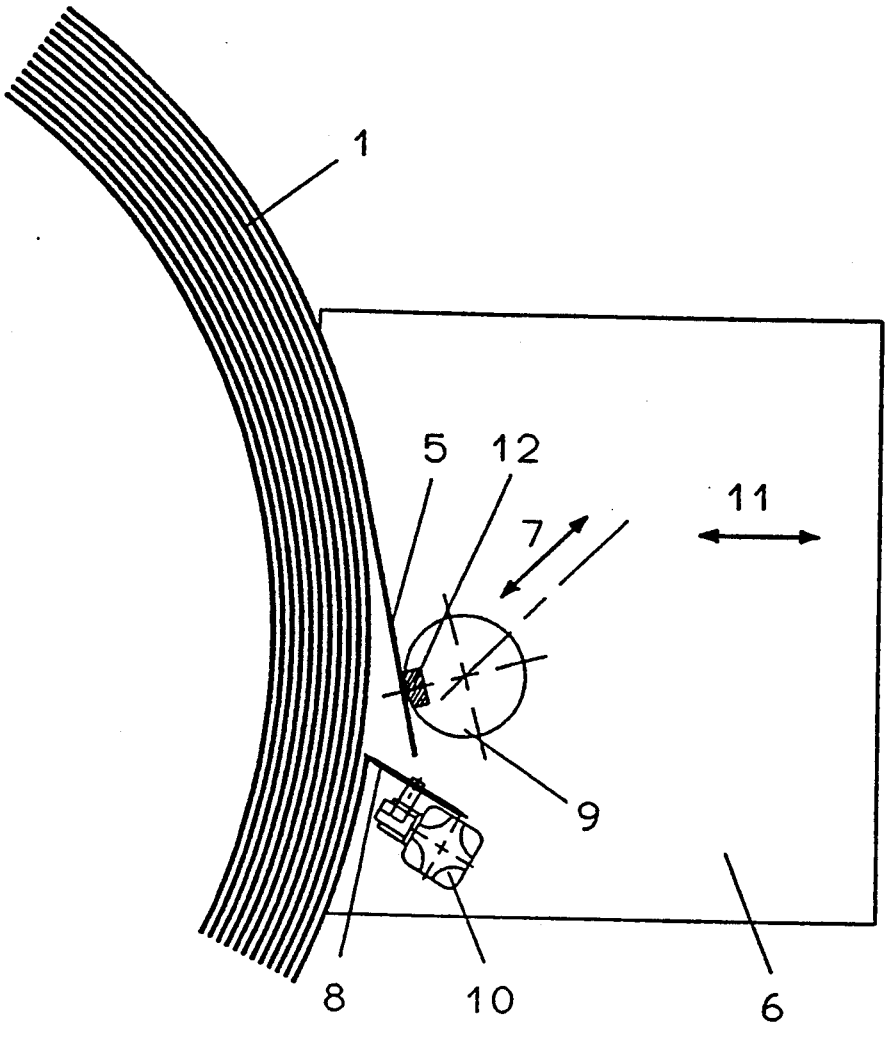
FIG. 6 illustrates the apparatus in a subsequent operating step in which the flap has been formed and is held.

Operation, With Reference to FIGS. 5 and 6

Figure 3:
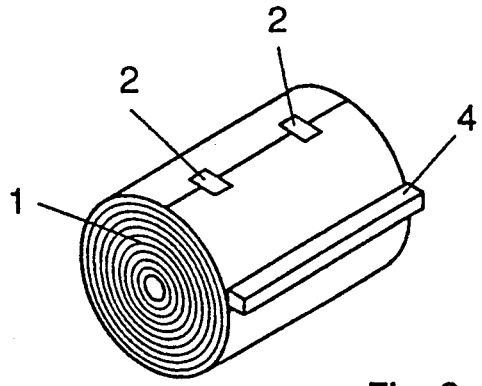
Figure 4:
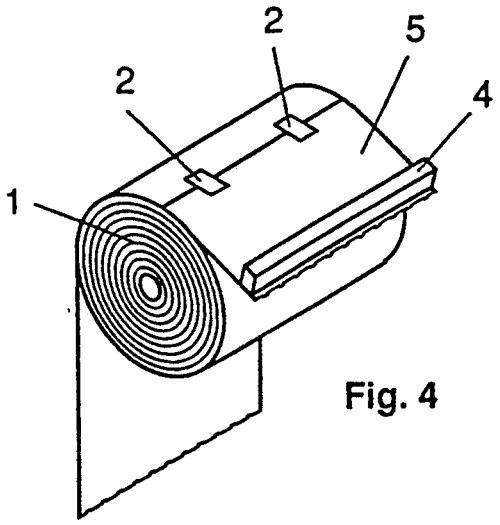

The frame 6 is shown in FIG. 5 in engagement with the roll 1. The circular perforating blade 8 engages the outer layer of the replacement roll, which is braked by a suitable brake, not shown, and well known in this field. The linear motion drive 10 then moves the rotary blade 8 axially along the replacement roll 1 to form the perforating line, or perforating cut 3 (FIG. 2). The roller 9, with the suction device 12 is then engaged against the portion of the upper layer of the roll 1 marked by the perforation line 3. The suction device 12 is energized, which will suck the flap 5 there against (FIG. 3). Upon reversing the direction of movement of the roll 9, in accordance with the arrow 7, a relative movement between the roller 9 and the replacement roll 1 will result, and the upper layer, adhered to suction device 12, will tear at the perforating line 3, to provide a newly formed starting portion or starting flap 5 (FIG. 4) for subsequent adhesion to an expiring web, for example.

Figure 7:
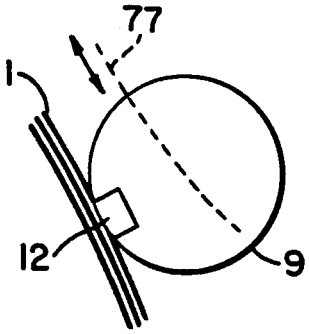
FIG. 7 is a highly schematic illustration showing another movement path for a relative movement between a holding roller 9 and the paper roll.

Relative movement between the roller 9 and the replacement paper roll 1 can be carried out in a straight line path, as shown by arrow 7; alternatively, it may occur in accordance with a curved track 77 (FIG. 7) which may be circular, or in accordance with an involute curve. Alternatively, or additional to the movement along the path 7 or 77, the roll 1 can be rotated clockwise, as schematically shown by arrow 7' to effect relative movement between the holding or suction device 12 and the roll 1 to effect tearing at the perforation line 3.

Figure 8:
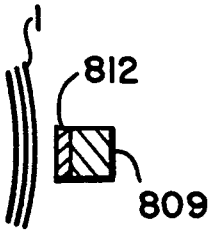
FIG. 8 illustrates an adhesive bar or strip for severing and holding a starting flap from the roll 1.
Figure 9:
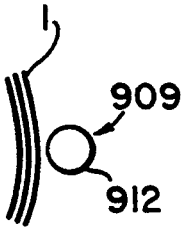
FIG. 9 illustrates an adhesively coated roller severing and holding the starting flap.

The holding device illustrated in FIGS. 5 and 6, in its simplest form is a roller 9 with a suction tube or suction strip 12. Other arrangements are also possible. FIG. 8 illustrates, in cross section, a holding strip 809, which has an adhesive facing 812 facing the roll 1. The adhesive facing is shown greatly enlarged for purposes of illustration. The strip 809 may be moved in the direction of double arrow 7, or in the curved path as indicated by the path 77, FIG. 7. In another embodiment, rather than using a strip or bar 809, a roller 909 with a temporarily or permanently adhesive surface 912 is used. Bar 809, as well as the roller 909 are shown removed from the roll 1 for purposes of illustration.

Formation and holding of a starting portion of a roll can be carried out within a roll change apparatus (now shown) but, just as well, in separate holders or roll stands outside of a roll changer. Particularly in installations of that kind, rather than moving the frame 6 against the roll 1, and the roller 9 and suction device 12 away from the roll 1, the relative movement can be carried out by keeping the frame and/or the roller 9 stationary and, rather, moving the roll 1. The important feature is only the relative movement of the respective elements. When using an adhesive surface cover 812 which is temporarily adhesive to permit release of the flap 5 on the bar or strip 809, or the surface 912 on the roller 909, an adhesive connection will result which is not intended to be permanent. Of course, rather than using a roller 9 with a suction device 12, a strip or rod or bar similar to the bar 809 with a suction device 12 can be used.

Figure 10:
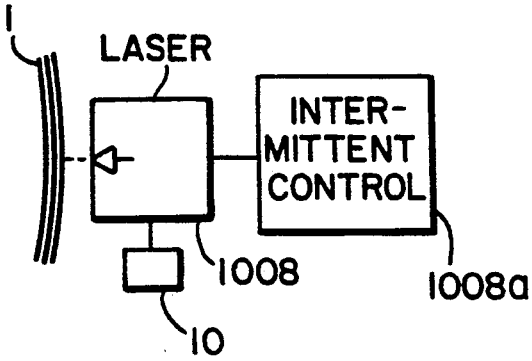
FIG. 10 illustrates a laser arrangement for forming a perforating line.

FIGS. 5 and 6 illustrate formation of the perforation line by a mechanical rotary perforating blade 8. Alternatively, the perforating can be carried out in other ways, and FIG. 10 illustrates moving a laser 1008, by a linear motion drive 10 (FIG. 1) axially along the roll 1, and controlling the laser, in clocked pulses by an intermittent control 1008A to form the perforating or severing line 3.

Various change in modifications may be made; the description, as well as the drawing has omitted features well known in the roll change of field, such as holding arms, holding spiders and the like since they can be of any suitable stand of construction.

I claim:

1. A method for the formation and holding of a loose starting flap (5) of a replacement paper roll (1), in which the uppermost or top layer of the replacement roll has a starting portion, the end of which is adhered to the then underlying layer of the roll, comprising the steps of perforating the uppermost layer of the roll inwardly of the end of the starting portion along a perforation line (3) which extends essentially parallel to the axis of the roll to define a flap portion located between the perforation line and the end;

adhering at least part of the flap portion of the uppermost layer to an adhering means (4; 9, 12; 809, 812, 909, 912); and relatively moving the adhering means and the roll with the uppermost flap portion adhered thereagainst to thereby tear the uppermost flap portion at said perforation line (3) and sever a flap (5) from the remainder of the roll along the perforation line (13) while said flap portion, and then said flap (5) is adhered to and held by said adhering means.

2. The method of claim 1 wherein said relative movement has a radial component, with respect to the roll.

3. The method of claim 1 wherein the step of relatively moving the adhering means and the roll comprising moving the adhering means away from the roll (1) in a curved path (77).

4. The method of claim 1 wherein the relative movement has a circumferential component with respect to the replacement roll (1).

5. The method of claim 1 wherein the step of adhering at least part of the flap portion comprises applying suction against the flap portion.

6. The method of claim 1, wherein the step of adhering the flap portion comprises adhesively adhering the flap portion to an adhesive carrier (809, 909).

7. The method of claim 1, wherein the step of relatively moving the adhering mean and the roll comprises rotating the replacement roll (1) in a direction which spaces said perforating line (3) from the adhering means, with the flap portion adhered thereto, to thereby tear said flap from the web.

8. An apparatus for the formation and holding of a loose flap (5) of a replacement paper roll (1) in which the replacement paper roll has an uppermost or top layer forming a starting portion, terminating in an end edge, said starting portion being adhered to an underlying layer of the roll, comprising roll perforating means (8, 1008) positionable against the uppermost layer of the roll (1) inwardly of the end edge of the starting portion;

moving means (10) relatively axially moving the perforating means (8, 1008) and the roll to form a perforating line (3) extending essentially parallel to the axis of the roll, to define a flap portion in the uppermost layer of the roll, said flap portion located between the perforating line and the end edge;

adhering means (9, 12; 809, 812; 909, 912), and support means (6, 7; 77) supporting and relatively moving the adhering means against the flap portion, said support means first relatively moving the adhering means toward the flap portion to permit adhesion of the flap portion thereagainst and, upon subsequent relative movement of the adhering means with respect to the replacement roll, tearing the flap portion of the uppermost layer from the underlying layer, thus forming a flap (5), said adhering means then holding the resulting flap (5) upon relative movement between the replacement roll and the support means.

9. The apparatus of claim 8, wherein said adhering means (12) comprises a suction means, optionally a suction strip, a suction bar, or a suction roller.

10. The apparatus of claim 8 wherein the adhering means comprises a roller (909) having an adhesive surface (912).

11. The apparatus of claim 8 wherein the adhering means comprises a rod or bar (809) having an adhesive surface (812).

12. An apparatus of claim 8 wherein the perforating means (8) comprises a circular rotary perforating blade (8), and the moving means comprises a linear motion control apparatus (10) moving said rotary perforating blade essentially axially with respect to said replacement roll (1).

13. An apparatus of claim 8 wherein said perforating means comprises a laser (1008) and a laser control means (1008A), controlling the laser for intermittent operation to form said perforating line, said laser being coupled to the moving means, comprises a linear drive (10), moving the laser at least approximately parallel to the axis of rotation of the replacement roll.

14. An apparatus of claim 8 further including a support frame (6) retaining said adhering means (4; 9, 12; 809, 812; 909, 912) and the perforating means (8, 1008), and the moving means (10), said frame and said roll (1) being relatively movable with respect to each other in an essentially radial direction of the replacement roll (1).

15. An apparatus of claim 8 further including a support frame (6) retaining said adhering means (4; 9, 12; 809, 812; 909, 912) and the perforating means (8, 1008), and the moving means (10), said frame and said replacement roll (1) being relatively movable with respect to each other in an essentially circumferential direction of the roll.

16. An apparatus of claim 8 further including a support frame (6) retaining said adhering means (4; 9, 12; 809, 812; 909, 912) and the perforating means (8, 1008), and the moving means (10), said frame and said replacement roll (1) being relatively movable with respect to each other in a direction towards and away from the circumference of the roll.

* * * * *